US007992798B2

(12) United States Patent
Bösterling et al.

(10) Patent No.: US 7,992,798 B2
(45) Date of Patent: Aug. 9, 2011

(54) SYSTEM FOR FASTENING A RAIL

(75) Inventors: Winfred Bösterling, Neuenrade (DE); Michael Steidl, Chicago, IL (US)

(73) Assignee: Vossloh-Werke GmbH, Werdohl (DE)

( * ) Notice: Subject to any disclaimer, the term of this patent is extended or adjusted under 35 U.S.C. 154(b) by 378 days.

(21) Appl. No.: 12/202,379

(22) Filed: Sep. 1, 2008

(65) Prior Publication Data

US 2009/0084864 A1 Apr. 2, 2009

(30) Foreign Application Priority Data

Sep. 21, 2007 (DE) ..... 10 2007 045 466

(51) Int. Cl.
*E01B 9/00* (2006.01)

(52) U.S. Cl. ..... 238/349; 238/351; 238/310

(58) Field of Classification Search ..... 238/349, 238/351, 310, 336, 338, 353, 354
See application file for complete search history.

(56) References Cited

U.S. PATENT DOCUMENTS

| | | | | |
|---|---|---|---|---|
| 4,632,307 | A * | 12/1986 | Weber | 238/265 |
| 4,770,343 | A * | 9/1988 | Heim et al. | 238/349 |
| 4,907,740 | A * | 3/1990 | Oberweiler et al. | 238/283 |
| 4,967,954 | A * | 11/1990 | von Lange | 238/310 |
| 5,096,119 | A * | 3/1992 | Schultheiss et al. | 238/349 |
| 6,257,495 | B1 * | 7/2001 | Eisenberg | 238/349 |
| 6,308,897 | B1 * | 10/2001 | Remington et al. | 238/292 |
| 7,637,438 | B2 * | 12/2009 | Schwiede et al. | 238/349 |

FOREIGN PATENT DOCUMENTS

| | | | |
|---|---|---|---|
| CH | 617479 | | 5/1980 |
| DE | 3507310 | | 9/1986 |
| WO | WO 94/15022 | * | 7/1994 |

OTHER PUBLICATIONS

"http://www.vossloh-fastening-systems.de/cms/en/products/system_ks/system_ks.html", Nov. 7, 2008.
"http://www.vossloh-fastening-systems.de/cms/media/downloads/pdfs/einbauanleitungen/Einbauanleitung_KS_GB.pdf", Nov. 7, 2008.

* cited by examiner

*Primary Examiner* — Mark T Le
(74) *Attorney, Agent, or Firm* — Proskauer Rose LLP

(57) ABSTRACT

A system for fastening a rail on a substrate includes a base plate, molded into which is a central portion, the width of which is adapted to the width of the rail foot of the rail to be fastened, with at least one fastening element for connecting the base plate to the substrate. The at least one tensioning element is provided for holding down the rail on the base plate. The system provides a fastening system allowing fastening of rails that satisfies modern requirements with the additional benefit of low production costs and simple assembly, while maintaining the basic configuration of the base plate provided and using simple means.

18 Claims, 3 Drawing Sheets

SYSTEM FOR FASTENING A RAIL

CROSS-REFERENCE TO RELATED APPLICATIONS

This application claims the benefit of and priority to German Patent Application No. DE 10 2007 045 466.1-25, filed on Sep. 21, 2007, which is owned by the assignee of the instant application. The disclosure of this application is incorporated herein by reference in its entirety.

FIELD OF THE INVENTION

The invention relates to a system for fastening a rail on a substrate, with a base plate, molded into which is a depressed central portion, the width of which is adapted to the width of the rail foot of the rail to be fastened, with at least one fastening element for connecting the base plate to the substrate and with at least one tensioning element provided for holding down the rail on the base plate.

BACKGROUND

Systems of this type are used in particular to fasten rails on a wooden sleeper in a simple manner. The purpose of the base plate, which is generally made of a steel as a hot-rolled or forged product, is in this case to transmit uniformly onto the sleeper the loads which occur when a railway vehicle travels over the fastening point formed by such a system.

In order to ensure rapid and at the same time particularly simple assembly, the base plates are fastened on a wooden sleeper during assembly conventionally with nails. The rail is also fastened on the base plate generally with nails which are struck through corresponding openings molded in the base plate. The nail head has in this case a portion protruding laterally relative to its shank. When it is struck into the wooden sleeper, the nail head is oriented in such a way that it rests, when fully struck in, on the rail foot and holds down the rail.

Fastening systems of the type described hereinbefore fulfil their purpose in track installations on which trains travel at a comparatively low speed. However, they do not meet the requirements of modern high-speed trains.

A large number of fastening systems which are able reliably to accommodate the dynamic loads occurring in high-speed trains are known. A typical example of a system of this type is offered by the Applicant under the name "System KS". Information about and an installation guide for this system are available from the URL "www.vossloh-fastening-systems.de".

The System KS has a base plate which is made of steel and is also referred to by experts as a "rib plate". The base plate has a central portion which is laterally delimited by a respective rib. The distance between the ribs corresponds in this case to the width of the rail foot of the rail to be fastened. A respective opening, positioned in which is a screw bolt, the threaded portion of which points away from the upper side of the respective rib, is molded into the ribs from the free upper side thereof. In addition, through-openings, through which the screws, which serve as fastening elements, can be screwed into the respective substrate, are molded into the base plate.

In the System KS, the holding forces required in order securely to hold the rail are generated by means of W-shaped tensioning clamps, each of which is mounted on one of the ribs. The loop-shaped central portion of the tensioning clamps is in this case placed around the threaded portion of the screw bolt inserted into the respective rib and braced against the base plate by means of a nut screwed onto the screw bolt. In this case, the spring arms of the tensioning clamp are supported with their free ends on the rail foot and thus resiliently hold down the rail. The resilient holding brought about in this way of the rail has the advantage that the fastening has a defined flexibility. This ensures that the rail is not excessively loaded even under the action of high dynamic forces.

SUMMARY OF THE INVENTION

In general, in one aspect, the invention provides a fastening system allowing, fastening of rails that satisfies modern requirements with beneficial production costs and simple assembly, while maintaining the basic configuration of the base plate provided and using simple means.

The fastening system according to the invention comprises a base plate. This base plate has a central portion, the bottom of which is lowered relative to the surface of the remaining portions of the base plate. The width of the central portion, measured transversely to the longitudinal direction of the rail to be fastened, is in this case adapted to the width of the rail foot of the rail to be fastened. Furthermore, the system according to the invention comprises at least one fastening element which is intended for connecting the base plate to the substrate and also at least one tensioning element provided for holding down the rail on the base plate.

In order to be able to continue using the above-listed basic components, which have already proved broadly successful in practice, and at the same time to allow fastening of the rail that is easily able to accommodate the loads which occur in modern high-speed railway traffic, the invention proposes moulding an opening into the base plate, which opening emanates from the upper side thereof associated with the rail, leads to the underside thereof associated with the substrate and has a non-circular cross-sectional shape.

According to the invention, the tensioning element is to be guided through this opening, starting from the underside of the base plate associated with the solid substrate. The tensioning element has, in the manner of a machine screw, a shank, a head which is formed integrally with the shank and the diameter of which is larger than the diameter of the shank, and a transition portion formed between the head and shank. The crucial thing is that the cross-sectional shape and dimensions of this transition portion are adapted to the shape and dimensions of the opening in the base plate in such a way that the transition portion is positioned, when introduced into the opening, in the opening so as to be prevented from rotating by a form fit. This allows the shank, which is guided through the opening, of the fastening element to protrude freely and non-rotatably beyond the free upper side of the base plate and thus to be used for bracing a spring element against the base plate.

This spring element can in this case be configured in a manner known per se. It accordingly has a spring arm which, when the spring element is braced against the base plate, exerts a resilient holding-down force onto the rail foot. For this purpose, the spring arm can press in a manner known per se with its free end portion onto the foot of the rail to be fastened.

The invention thus provides a fastening system which not only allows the base plate which is known in the art and has proven successful in practice to continue to be used, but rather in addition also allows a likewise known spring element to be used for resiliently supporting the rail. In this case, the rail is fastened in a manner which ensures that the rail can yield even to forces occurring in high load mode with a resilience which ensures that the rail is subjected to significantly reduced wear, compared to the prior art, even when used for a long time.

In a system according to the invention, the tensioning element is prevented from becoming lost as a result of the fact that it is introduced into the opening in the base plate from the underside, and the head, the diameter of which is larger than the diameter of the transition portion at least in certain portions, is supported at the underside of the base plate. When the fastening system is fully assembled, i.e. when the base plate is placed onto the substrate, the substrate accordingly covers the screw head. In order to ensure that the screw head does not prevent the base plate from lying on the substrate over its entire area, a correspondingly formed depression can be molded into the substrate. However, with regard to the possibility of preassembly, it is particularly advantageous if the opening associated with the tensioning element merges, on the underside of the base plate associated with the substrate, with a depression, the cross-sectional shape and dimensions of which are adapted to the shape of the head of the tensioning element in such a way that the head of the tensioning element is positioned in the depression when the tensioning element is inserted into the respective opening in the base plate from the underside. The dimensions of the depth of the depression are in this case preferably such that the head of the tensioning element is positioned completely in the depression when the system is fully assembled.

The form fit which prevents the tensioning element from rotating can be formed as a result of the fact that the transition portion of the tensioning element has a cross-sectional shape with at least one distinct corner. In terms of production, this can be achieved in a particularly simple manner, for example, when the transition portion of the tensioning element has a quadrilateral cross section.

If the system according to the invention is to be delivered preassembled to the construction site, it can be beneficial if an interference fit is superimposed on the form fit of the transition portion in the opening associated with the tensioning element. An interference fit of this type can for example be achieved as a result of the fact that the diameter of the opening in question is slightly smaller than the transition portion of the tensioning means.

The self-centering of the tensioning means in the depression can be assisted as a result the fact that the head of the tensioning element is configured so as to run obliquely in the direction of the transition portion.

A particularly simple possibility for bracing the spring element on the base plate is obtained when an outer thread is molded, starting from its free end, into the shank of the tensioning element and a nut, which can be screwed onto the outer thread, is provided for tensioning the spring element.

The possibility of using spring elements which are known per se and have proven broadly successful in practice also in a system according to the invention can additionally be extended as a result of the fact that there is provided a guide plate which can be laid onto the base plate and has a recess, through which the shank of the tensioning element can be inserted, and at its free upper side, which is remote from its underside associated with the base plate, a shaped element for guiding at least a portion of the spring element supported on the base plate. The guide plate thus shaped can be used to support the spring element in such a way that it substantially maintains its basic shape even when deformed and thus transmits maximum holding forces onto the rail via its spring arms.

Conventionally, the known base plates have on their upper side rib shoulders which are arranged adjoining the central portion and extend parallel to the longitudinal direction of the rail to be fastened. These rib shoulders prevent the rail from moving out of the lowered central portion, when vehicles travel over said rail, as a result of transverse forces which occur. The shape of the transition between the respective rib shoulder and the side portion laterally adjoining said rib shoulder on the side remote from the central portion is generally not unambiguously configured and is subject to high production inaccuracies. Thus, it can be configured in a groove-like, step-like or other manner.

In order nevertheless to ensure, even in base plates provided with rib shoulders, positionally secure and permanently constant supporting of the guide plate, according to a further particularly practical configuration of the invention, an, in particular web-like, projection, via which the guide plate is supported on the respective rib shoulders when the system is fully assembled, is formed on the underside of the guide plate. As a result of the fact that it is supported via the web, the area of contact between the guide plate and the respective rib shoulder is reduced to a minimum. As a result of the fact that supporting of the guide plate over the entire area is purposefully dispensed with, the shape of the ribs and the shape of their transition to the adjoining side portion accordingly have no influence on the position which the guide plate assumes.

Particularly secure and simple positioning of the guide plate can be ensured as a result of the fact that, according to the invention, the recess in the guide plate is formed as an opening surrounded by the material of the guide plate.

A further variation of the invention that is particularly beneficial for practical application is characterized in that two projections, which are arranged set apart from each other and are intended laterally to surround one of the fastening elements intended for connecting the base plate to the substrate, are configured at a portion of the guide plate. The projections laterally adjoining the respective fastening element prevent, in the simplest manner conceivable, the guide plate from rotating without requiring for this purpose shaped elements which are complex to produce at the base plate or additional fastening parts.

The base plate used and configured in accordance with the invention can also, like the known base plates of the type specified at the outset, have openings for guiding through the fastening elements provided in each case for connecting the base plate to the substrate. In order on the one hand to ensure that the connection between the substrate and the base plate is produced at a particularly beneficial position and on the other hand to be able to use the respective fastening element for fixing the position of the guide plate, it is in this case expedient if the center points of the opening associated with the tensioning element and an opening associated with one of the fastening elements are jointly arranged on a straight line which is oriented transversely to the longitudinal direction of the rail to be fastened.

If a second fastening element is required for fastening the base plate on the solid substrate, an opening can be molded into the base plate for this element too. Specifically when the solid substrate is made of wood or a material having a similarly fibrous structure, the risk of splitting of the sleeper by the pressure exerted by the respective fastening element when screwed in can be avoided as a result of the fact that the center point of the opening provided for the second fastening element is arranged on a straight line which extends parallel to the longitudinal direction of the rail to be fastened and intersects the connecting line between the center points of the opening for the first fastening element and the opening of the tensioning element at a point lying between these two center points.

Typically, in fastening systems according to the invention as in the prior art, the rail is held in each case on both sides by corresponding tensioning elements. Accordingly, in a system according to the invention too, at least one opening for a tensioning element and at least one opening for a fastening element will regularly be molded into the side portions of the base plate that adjoin the central portion on both sides. Insofar as the openings molded in accordance with the invention into the base plate are in this case arranged toward the center of the width of the base plate, it is beneficial, in order to simplify positionally correct assembly, to arrange the openings of the two side portions point-symmetrically.

In principle, it is possible to use nails or other fastening elements which can be driven into the respective solid substrate by being struck also for connecting the base plate used in a system according to the invention. Particularly operationally reliable fastening is however obtained when the fastening elements are screws. If the solid substrate is formed by wooden sleepers, these screws can either be configured as self-tapping screws or be screwed into correspondingly pre-shaped openings. If the system according to the invention is provided for fastening a rail on a substrate formed by concrete sleepers or plates, dowels, into which the fastening screws provided in accordance with the invention are then screwed, can be inserted into this substrate in a manner also known per se.

DESCRIPTION OF THE DRAWINGS

The invention will be described hereinafter in greater detail with reference to drawings which illustrate an exemplary embodiment and in which.

DESCRIPTION

Figure 1:
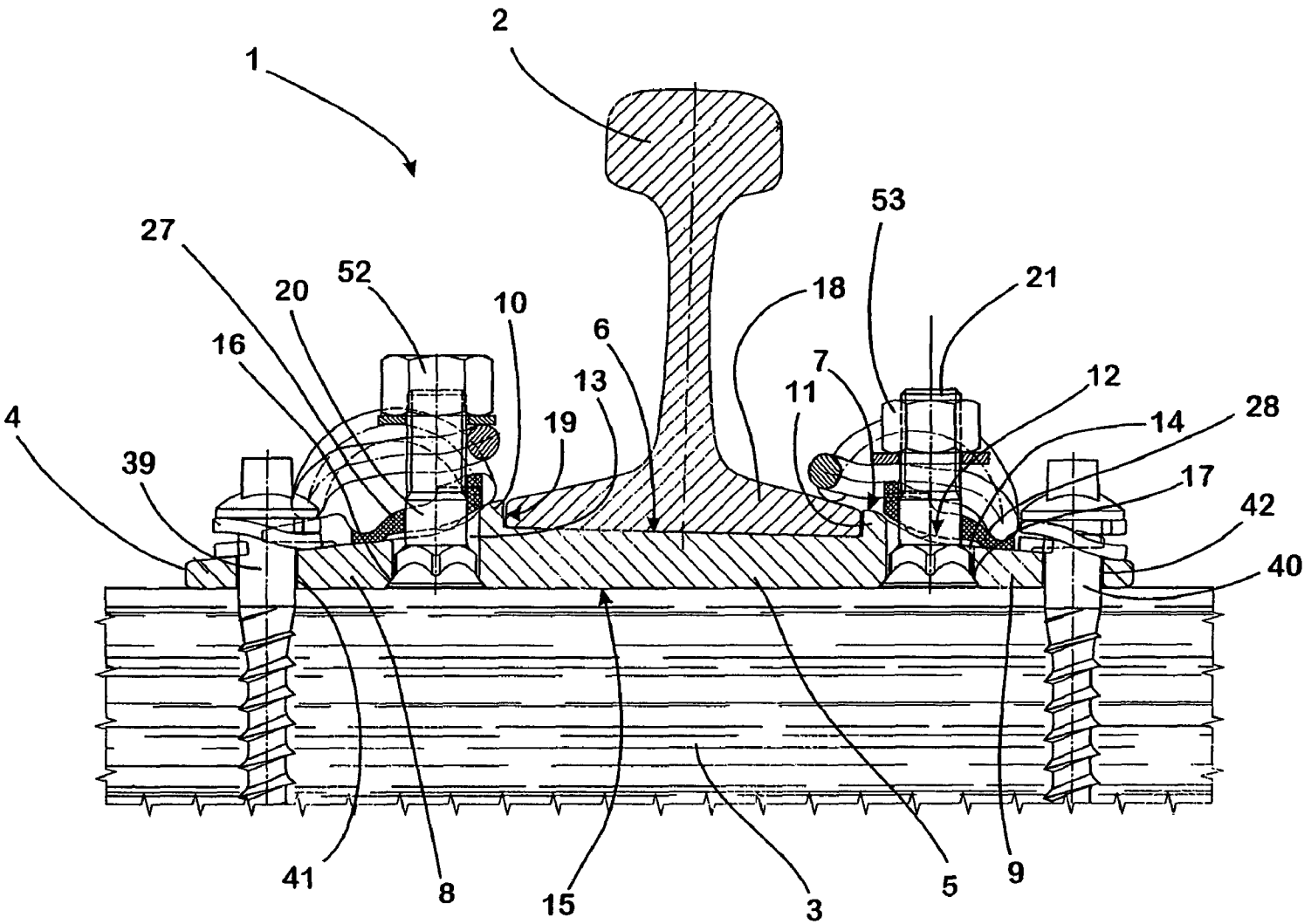
FIG. 1 is a cross section of a system for fastening a rail on a wooden sleeper.

The system 1 for fastening a rail 2 on a wooden sleeper 3 comprises a conventionally shaped base plate 4 into which a central portion 5 extending over the entire width B of the base plate 4 is molded.

The bottom 6 of the central portion 5 is lowered relative to the adjoining free surface 7 of the side portions 8, 9 of the base plate 4 adjoining the central portion 5 on both sides, so that the central portion 5 is laterally delimited by rib shoulders 10, 11 likewise extending over the entire width B of the base plate 4 in the longitudinal direction L of the rail 2.

The rib shoulders 10, 11 pass in a groove-like transition 12 into the region of the side portions 10, 11 adjoining them on the side remote from the central portion 5. The transition 12 has in this case no defined shape and can differ from base plate to base plate.

A respective first opening 13, 14, which is arranged in the close vicinity of the respective rib shoulder 10, 11, is molded into the side portions 10, 11 of the base plate 4. The openings 13, 14 lead in this case from the upper side 7 of the side portions 10, 11 to the underside 15 of the base plate 4 associated with the sleeper 3.

In the direction of the underside 15 of the base plate 4, the openings 13, 14 merge in each case with depressions 16, 17 molded into the base plate 4 from the underside 15. The inner surfaces of the depressions 16, 17 run in this case conically toward one another in the direction of the respective opening 13, 14.

The openings 13, 14 have in each case a square cross-sectional shape in which one corner is positioned next to the respective rib shoulder 10, 11, so that the side surfaces of the respective opening 13, 14 running toward this rib shoulder 10, 11 are oriented at an angle of approx. 45° relative to the respective contact surface 19 of the rib shoulders 10, 11 associated with the rail foot 18.

A tensioning element 20, 21 configured in the manner of a screw is respectively positioned in each of the openings 13, 14. The tensioning elements each have a shank 22, a transition portion 23 adjoining the shank 22, and a head 24 formed integrally with the transition portion 23. The head 24 has a cross section which is circular, when viewed from above, and the diameter of which is larger than the largest diameter of the transition portion 23. The largest diameter thereof is again larger than the diameter of the shank 22 which is also circular in cross section.

The circumferential surface of the head 24 of the tensioning elements 20, 21 tapers in the direction of the transition 23 at a gradient which is adapted to the gradient of the inner surfaces of the depressions 16, 17. At the same time, the depth of the depressions is adapted to the height of the head 24 of the tensioning elements 20, 21, so that the head 24 are each oriented with their head side 25, when the tensioning element 20, 21 is inserted fully into the respective opening 13, 14, flush with the underside 15 of the base plate 4.

The shape and dimensions of the cross section of the transition portion 23 of the tensioning elements 20, 21 are adapted to the shape and the dimensions of the openings 13, 14 in such a way that the respective tensioning element 20, 21 can be inserted into the associated opening 13, 14 with slight play and is non-rotatably held, when fully inserted into the opening 13, 14, by a form fit with respect to rotation about the longitudinal axis of the respective tensioning element 20, 21.

An outer thread 26 is molded into the shank 22, starting from the free end thereof.

A respective guide plate 27, 28 is laid onto the upper side 7 of the side portions 8, 9. The guide plates 27, 28 are made of a plastics material and each have a recess 29 formed as a through-opening surrounded by the material of the respective guide plate 27, 28. In the assembled state illustrated in FIGS. 1 and 2, the shank 22 of the respective tensioning element 20, 21 is guided through this recess 29.

The recess 29 is molded into a first portion 30 of the guide plates 27, 28 that passes into a second portion 31 which is wider in its configuration than the first portion 30. The planar free end face 32 of the first portion 30 of the guide plates 27, 28 is associated with the rail foot 8.

A shaped element 33, which is deepened in the manner of a channel, is molded into the upper side of the second portion 31, adjoining the first portion 30 of the guide plates 27, 28. In addition, two projections 34, which point diametrically away from the end face 32 and laterally surround a recess 35 in a U-shaped manner, are configured at the second portion 31.

At the underside 36 of the guide plates 27, 28, a web-like projection 37, which extends parallel to the end face 32 and intersects the opening 9, is configured in the region of the first portion 30.

A further web-like projection 38, also extending parallel to the end face 32, is shaped in the region of the second portion 31 of the guide plates 27, 28 below the shaped element 33.

Figure 2:
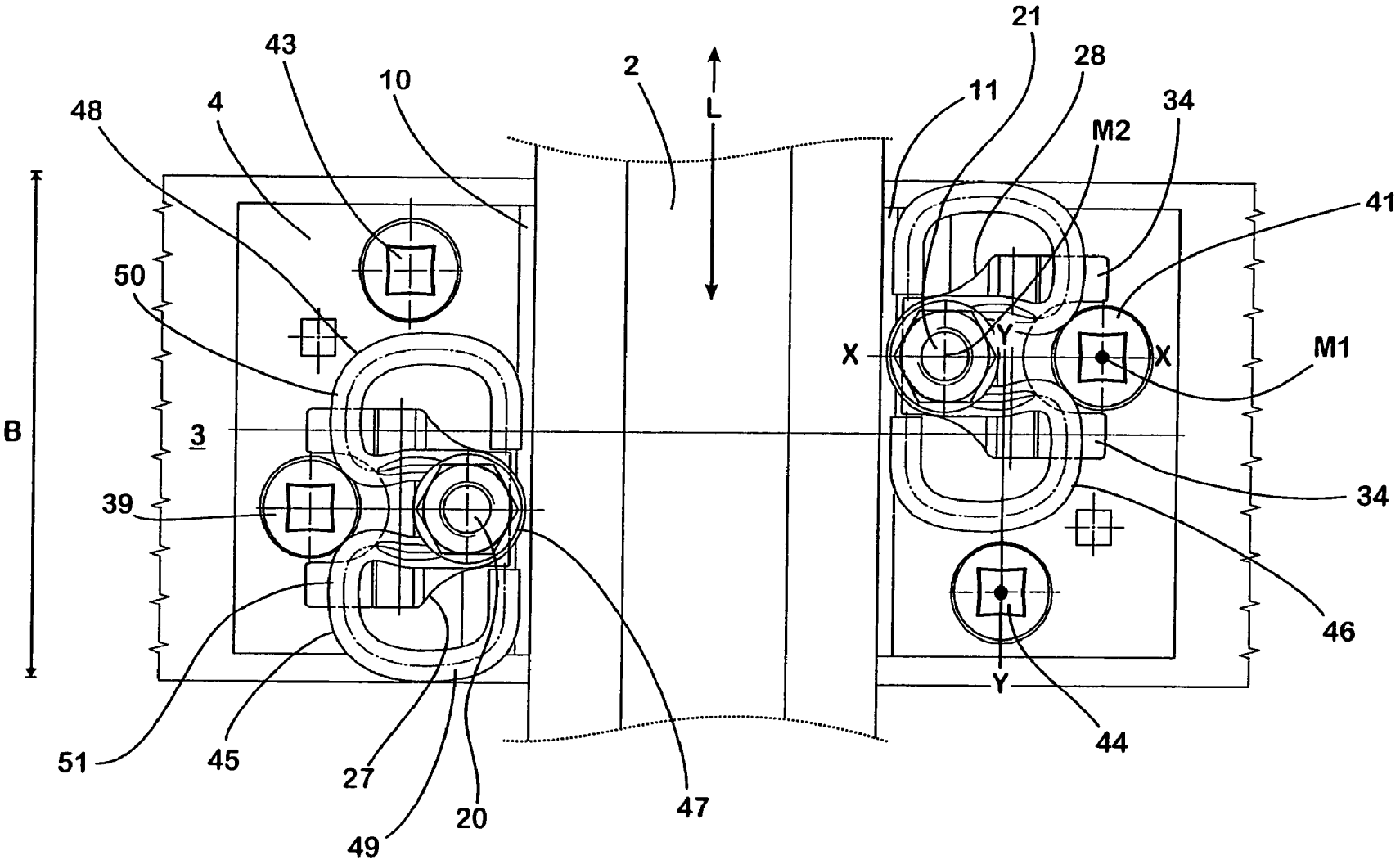
FIG. 2 is a plan view of the system according to FIG. 1.
Figure 5:
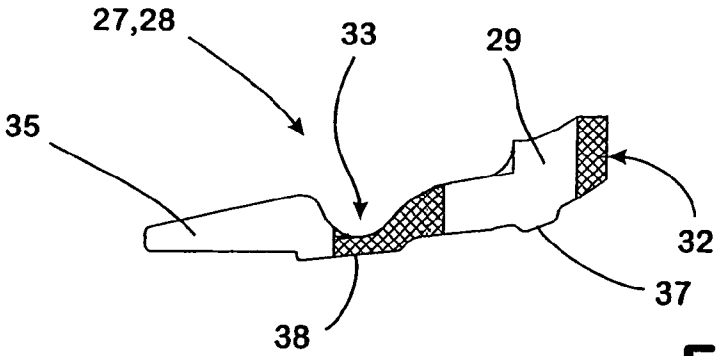
FIG. 5 is a longitudinal section of the guide plate.
Figure 4:
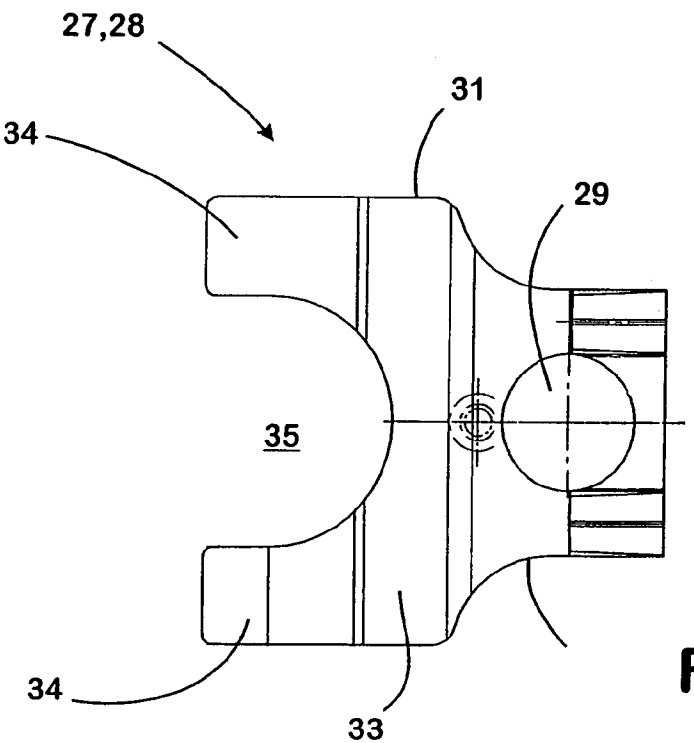
FIG. 4 is a plan view of a guide plate used in FIGS. 1 and 2.
Figure 3:
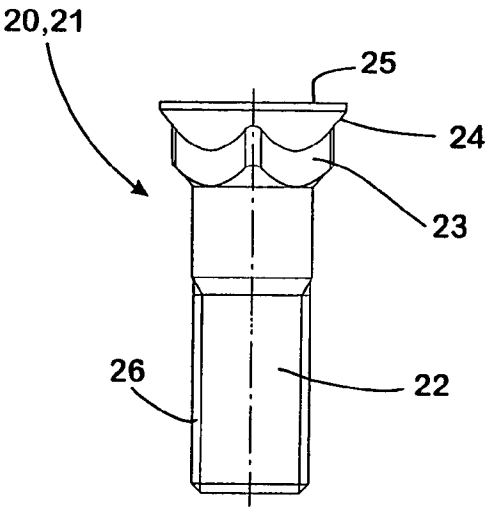
FIG. 3 is a lateral view of a tensioning element used in FIGS. 1 and 2.

In the assembled state shown in FIGS. 1 and 2, the guide plates 27, 28 are supported on the upper side 7 of the base plate 4 via their web-like projections 37, 38. The projection 37 rests in this case on the rib shoulder 10, 11 associated with the respective guide plate 27, 28. In this way, the respective transition 12 is bridged, so that the respective guide plate 27, 28 rests on the base plate 4 in all cases in a positionally secure manner, irrespective of the shape of the transition.

In the assembled state, a fasting element 39, 40 configured as a screw is positioned with its screw head 41 in the recess 35 in the guide plates 27, 28. The fastening elements 39, 40 are screwed into the wooden sleeper 3 in each case by a further opening 41, 42 molded into the base plate 4. The center point M1 of the openings 41, 42 lies in this case on a straight line X which extends through the center point M2 of the opening 13, 14 respectively associated therewith and is oriented, viewed from above (FIG. 2), transversely to the longitudinal direction L of the rail 2 to be fastened.

The openings 13, 41 of the side portion 8 and the openings 14, 42 of the side portion 9 are each arranged in one half of the respective side portion 8, 9. In addition to the fastening by the fastening elements 39, 40, the respective side portions 8, 9 are each connected to the wooden sleeper 3 via a further, likewise screw-like fastening element 43, 44.

The additional fastening elements 43, 44 are in this case each guided through an opening (which cannot be seen here) formed in the respective other half of the side portions 8, 9.

The center point M3 of this opening lies in this case on a straight line Y which is oriented perpendicularly to the straight line A and, viewed from above (FIG. 2), intersects said straight line A between the center points M1, M2. This arrangement minimizes the risk of the wooden sleeper 3 splitting as a result of the forces exerted by the fastening elements 39, 40, 43, 44.

The openings 13, 41 with the opening for the additional fastening element 43 of the side portion 8 are positioned point-symmetrically to the openings 14, 42 with the opening for the additional fastening element 44 of the side portion 9.

A respective spring element 45, 46, which is a conventional commercial tensioning clamp shaped in the shape of a W, is supported on the guide plates 27, 28. The spring elements 45, 46 are in this case oriented in such a way that their central loop 47 is guided around the shank 22 of the tensioning element 20, 21 respectively associated with said spring elements, and the regions of transition from the central loop 47 to the portions 50, 51 leading to the spring arms 48, 49 formed integrally therewith are positioned in the channel-like shaped element 33 of the respective guide plate 27, 28. In the fully assembled state (shown on the right-hand side in FIG. 1, 2), the spring arms 48, 49 of the spring elements 45, 46 rest with their free ends on the rail foot 18 and resiliently load said rail foot with the required holding-down force. In the preassembled state (shown on the left-hand side in FIG. 1, 2), the respective spring element 45, 46 is slid away from the central portion 5 sufficiently far that the end of the spring arms 48, 49 rests on the respective rib shoulder 10, 11 and the rail 2 can be placed into the central portion 5 unimpeded.

The spring elements 45, 46 are braced against the base plate 4 in this case via a respective nut 52, 53 which is screwed onto the shank 24 of the respective tensioning element 20, 21.

The invention claimed is:

1. System for fastening a rail on a substrate, with a base plate, molded into which is a central portion, a width of the base plate is adapted to a width of a rail foot of the rail to be fastened, with at least one fastening element for connecting the base plate to the substrate and with at least one tensioning element provided for holding down the rail on the base plate, wherein an opening is molded into the base plate, which opening emanates from an upper side thereof associated with the rail, leads to an underside thereof associated with the substrate and has a non-circular cross-sectional shape, the at least one tensioning element is intended to be slid into the opening from the underside of the base plate and includes a shank, a head which is formed integrally with the shank and a diameter of the head is larger than a diameter of the shank, and a transition portion which is formed between the head and the shank and a cross-sectional shape and dimensions of the transition portion are adapted to a shape and dimensions of the opening in the base plate in such a way that the transition portion is positioned, when placed into the opening, in the opening so as to be prevented from rotating by a form fit, a spring element is provided which can be braced against the base plate with an aid of the at least one tensioning element and has at least one spring arm which, when the spring element is braced against the base plate, exerts a resilient holding-down force onto a rail foot, a guide plate is provided which can be laid on the base plate and has a recess, through which the shank of the at least one tensioning element can be inserted, and at a free upper side, which is remote from an underside associated with the base pate, a shaped element for guiding at least a portion of the spring element supported against the base plate; and two projections, which are arranged set apart from each other and are intended laterally to surround one of the at least one fastening element intended for connecting the base plate to the substrate, are configured at a portion of the guide plate.

2. System according to claim 1, wherein the opening in the base plate merges, on the underside of the base plate associated with the substrate, with a depression, a cross-sectional shape and dimensions of the depression are adapted to a shape of the head of the at least one tensioning element in such a way that the head of the at least one tensioning element is positioned in the depression when the at least one tensioning element is inserted into the opening in the base plate from the underside.

3. System according to claim 2, wherein dimensions of the depth of the depression are such that the head is positioned completely in the depression when the system is fully assembled.

4. System according to claim 1, wherein the transition portion of the at least one tensioning element has the cross-sectional shape with at least one distinct corner.

5. System according to claim 4, wherein the transition portion of the at least one tensioning element has a quadrilateral cross section.

6. System according to claim 1, wherein the head of the at least one tensioning element is configured so as to run in a direction of the transition portion.

7. System according to claim 1, wherein an outer thread is molded, starting from its free end, into the shank of the at least one tensioning element and in that a nut, which can be screwed onto the outer thread, is provided for tensioning the spring element.

8. System according to claim 1, wherein rib shoulders arranged on the upper side of the base plate adjoining the central portion are molded.

9. System according to claim 8, wherein a projection, through which the guide plate is supported on one of the rib shoulders when the system is fully assembled, is formed on an underside of the guide plate.

10. System according to claim 1, wherein the recess in the guide plate is formed as an opening surrounded by the material of the guide plate.

11. System according to claim 1, wherein the base plate has openings for guiding through the at least one fastening element which are each provided for connecting the base plate to the substrate.

12. System according to claim 11, wherein center points of the opening associated with the at least one tensioning element and an opening associated with a first fastening element are jointly arranged on a straight line which is oriented transversely to a longitudinal direction of the rail to be fastened.

13. System according to claim 12, wherein an opening associated with a second fastening element is molded into the base plate and in that a second center point of this opening is arranged on a straight line which extends parallel to the longitudinal direction of the rail to be fastened and intersects the connecting straight line between the center points of the opening for the first fastening element and the opening of the at least one tensioning element at a point lying between the center points.

14. System according to claim 1, wherein the at least one opening for a tensioning element and at least one opening for a fastening element are molded into side portions of the base plate that adjoin the central portion on both sides.

15. System according to claim 14, wherein the at least one opening for a tensioning element and the at least one opening for the fastening element are arranged point-symmetrically.

16. System according to claim 1, wherein the at least one fastening element is a screw.

17. System according to claim 1, wherein the at least one fastening element is a nail.

18. System according to claim 1, wherein rib shoulders arranged on the upper side of the base plate adjoining the central portion are molded.

* * * * *

UNITED STATES PATENT AND TRADEMARK OFFICE

CERTIFICATE OF CORRECTION

PATENT NO. : 7,992,798 B2
APPLICATION NO. : 12/202379
DATED : August 9, 2011
INVENTOR(S) : Bösterling et al.

It is certified that error appears in the above-identified patent and that said Letters Patent is hereby corrected as shown below:

In Claim 1, at column 8, line 23, delete “pate” and replace it with “plate”

Signed and Sealed this
Eighth Day of November, 2011

David J. Kappos

David J. Kappos
*Director of the United States Patent and Trademark Office*